United States Patent [19]

Yoshida

[11] Patent Number: 4,921,457

[45] Date of Patent: May 1, 1990

[54] MARINE PROPULSION DEVICE

[75] Inventor: Shinji Yoshida, Hamamatsu, Japan

[73] Assignee: Sanshin Kogyo Kabushiki Kaisha, Hamamatsu, Japan

[21] Appl. No.: 314,239

[22] Filed: Feb. 21, 1989

Related U.S. Application Data

[63] Continuation of Ser. No. 106,050, Oct. 7, 1987, abandoned.

[30] Foreign Application Priority Data

Oct. 8, 1986 [JP] Japan ..... 61-239831

[51] Int. Cl.[5] ..... B63H 21/28

[52] U.S. Cl. ..... 440/111; 440/75; 440/76; 440/77

[58] Field of Search ..... 440/75, 76, 77, 78, 440/111

[56] References Cited

U.S. PATENT DOCUMENTS

| | | | |
|---|---|---|---|
| 1,683,893 | 9/1928 | Irgens | 440/75 |
| 2,501,470 | 3/1950 | Krueger et al. | 440/77 |
| 2,609,782 | 9/1952 | Kiekhaefer | 440/78 |
| 3,025,822 | 3/1962 | Tenney | 440/75 |
| 3,896,757 | 7/1975 | Kucher | 440/75 |
| 3,967,446 | 7/1976 | Harralson et al. | 440/89 |
| 3,968,767 | 7/1976 | Blanchard | 440/75 |
| 4,378,219 | 3/1983 | Tanaka | 440/75 |
| 4,583,953 | 4/1986 | Nakase | 440/76 |
| 4,679,673 | 7/1987 | Yamaoka | 440/75 |

FOREIGN PATENT DOCUMENTS

| | | | |
|---|---|---|---|
| 33596 | 2/1983 | Japan | 440/77 |
| 38194 | 3/1984 | Japan | 440/111 |

*Primary Examiner*—Sherman D. Basinger
*Assistant Examiner*—Thomas J. Brahan
*Attorney, Agent, or Firm*—Ernest A. Beutler

[57] ABSTRACT

A propulsion device for a marine application or the like that includes an engine and propulsion unit that contains a transmission. The engine and propulsion unit are connected together by means of a connector plate. A first series of threaded fasteners connect the connector plate to the engine and a second series of threaded fasteners connect the propulsion unit to the connector plate.

4 Claims, 4 Drawing Sheets

MARINE PROPULSION DEVICE

This is a continuation of U.S. Pat. Ser. No. 106,050, filed Oct. 7, 1987 Marine Propulsion Device, now abandoned.

BACKGROUND OF THE INVENTION

This invention relates to a marine propulsion device and more particularly to an improved arrangement for interconnecting an internal combustion engine and a propulsion unit.

There are many instances wherein an internal combustion engine is connected in driving relationship to a propulsion unit that incorporates a transmission for coupling the engine output shaft to a driven device. One typical application of this type is found in watercraft wherein an engine may be contained within a protective cowling and supported with its output shaft rotating about its vertically extending axis. Affixed to the underside of the engine is a propulsion unit that includes a transmission and may drive a propeller shaft or the like. Frequently, such a propulsion unit will incorporate a forward-neutral-reverse transmission for propulsion of the watercraft through the body of water in which it is operating. In connection with such an arrangement, it is essential that the engine and propulsion unit be connected to each other in a rigid and compact manner and yet the connection should be such as to facilitate servicing.

One manner in which the components may be fastened together is by means of a plurality of through bolts that extend through each of the housings and which connect them together. However, such an arrangement is not always satisfactory because it does give rise to certain problems in connection with disassembly of the components. Furthermore, the lower portion of the engine usually has a smaller dimension than the upper portion of the propulsion unit and this means that the connectors are positioned in an inaccessible location or one which requires substantially disassembly for servicing. In addition, such types of connections frequently offer an unsightly appearance because of the difference in size of the components connected.

It is, therefore, a principal object of this invention to provide an improved and simplified arrangement for interconnecting in the engine with a propulsion unit.

It is a further object of this invention to provide an engine, propulsion unit interconnection system that will offer ease of servicing and disassembly and, at the same time, a compact configuration.

It is yet another object of this invention to provide an improved and simplified interconnecting device for interconnecting an engine and propulsion unit for marine applications.

SUMMARY OF THE INVENTION

This invention is adapted to be embodied in a propulsion device that is comprised of an internal combustion engine contained within a protective cowling and which has its output shaft rotatable about a vertically extending axis and an interconnected propulsion unit. The propulsion unit is positioned beneath the protective cowling and contains a transmission device driven by the engine output shaft and driving a propulsion shaft. A connecting plate is affixed to the engine by a first set of fasteners that are positioned about the axis of the output shaft at a first dimension. A second set of fasteners affix the propulsion unit to the connection plate outwardly of the first set of fasteners.

DETAILED DESCRIPTION OF THE PREFERRED EMBODIMENT

Figure 1:
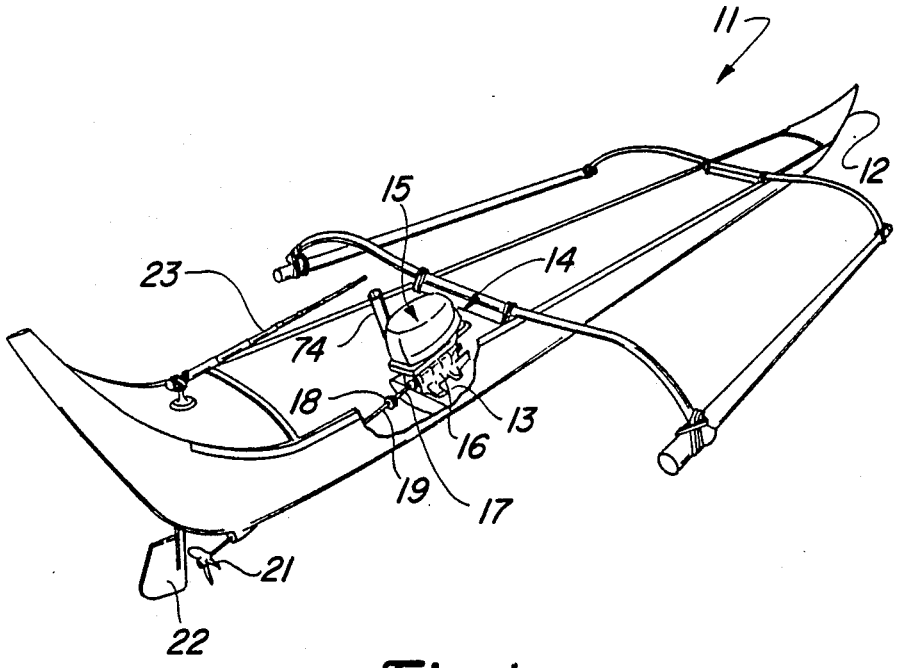
FIG. 1 is a perspective view, with a portion broken away, taken from the rear and one side of a small watercraft powered by a propulsion device constructed in accordance with an embodiment of the invention.
Figure 2:
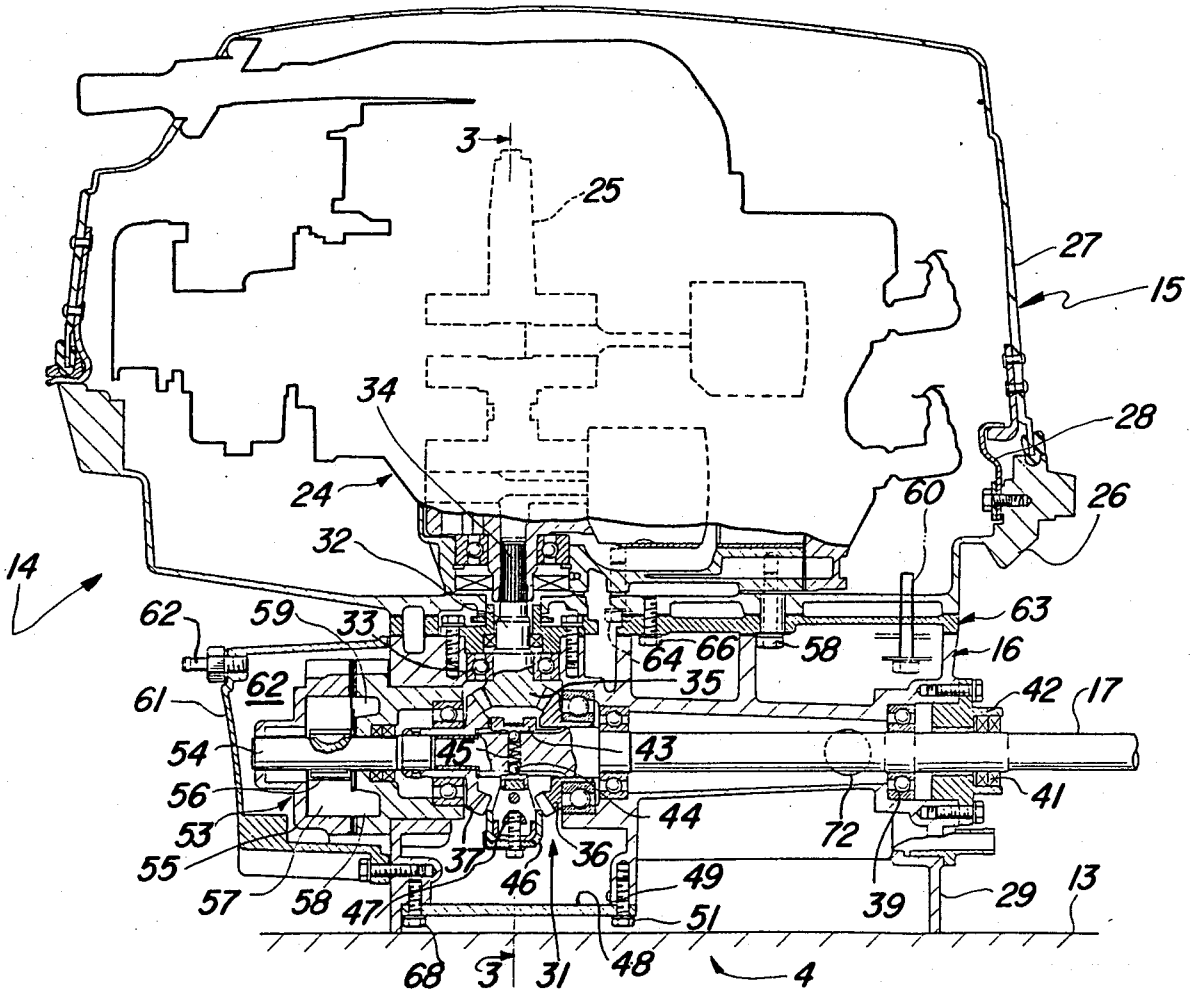
FIG. 2 is an enlarged side-elevational view of the propulsion unit, with portions broken away and other portions shown in section.
Figure 3:
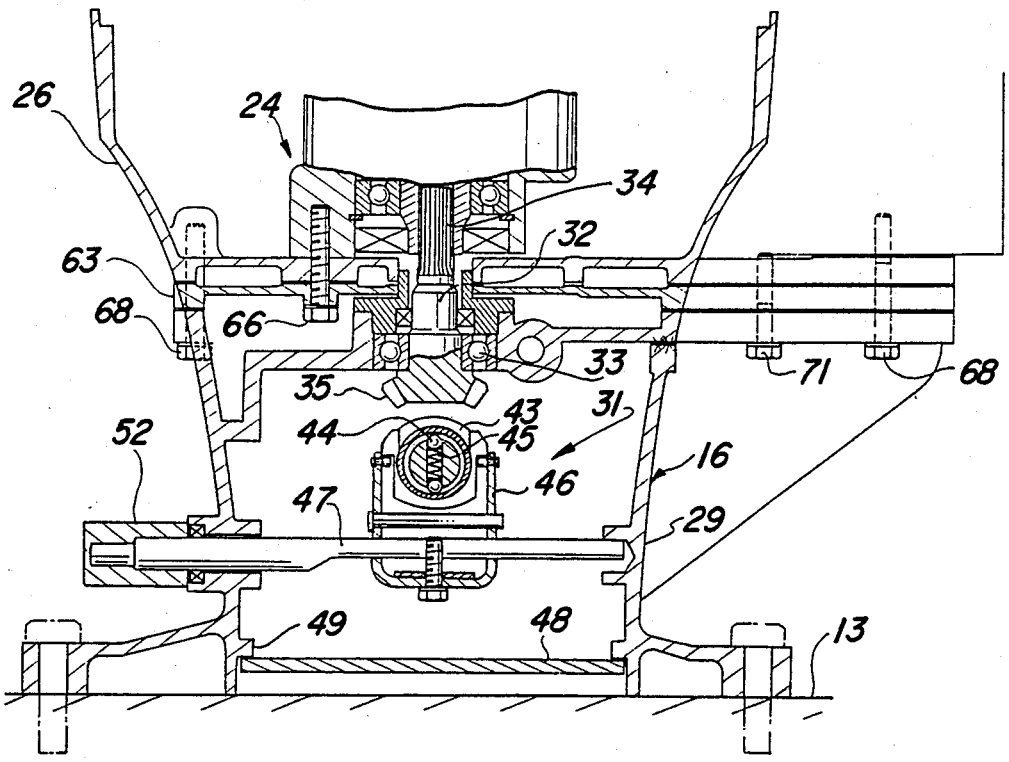
FIG. 3 is a cross-sectional view taken along the line 3—3 of FIG. 2.

Referring first to FIG. 1, a small watercraft is identified generally by the reference numeral 11 and is typical of one environment in which the invention may be employed. The watercraft 11 includes a hull 12 having a bearing plate 13 that supports a propulsion device which is constructed in accordance with an embodiment of the invention and which is identified generally by the reference numeral 14. The propulsion device 14 is comprised of a power unit, indicated generally by the reference numeral 15 and a propulsion unit, indicated generally by the reference numeral 16. The power unit 15, as will become apparent by further description of the invention by reference to FIGS. 2 and 3, is comprised of an internal combustion engine and surrounding protective cowling. The propulsion unit 16 includes a transmission that is driven by the engine output shaft and which drives a propulsion shaft 17.

In the illustrated embodiment, the watercraft 11 is of the inboard type. To this end, the propulsion shaft 17 is coupled by means of a coupling 18 to a propeller shaft 19 that is journalled within the hull 12 and which drives a propeller 21 positioned at the rear of the hull. It is to be understood that, even though the invention is described in conjunction with an inboard application, the invention has equal applicability to outboard drives for watercraft. As has been previously noted, the invention also has other utility in other applications.

The watercraft 12 is steered by a rudder 22 which is, in turn, controlled by a tiller 23. As noted, the watercraft 11 is typical of only one of the applications in which the invention may be found and for that reason further details of the construction of the watercraft are not believed to be necessary to understand the invention or its application.

Figure 4:
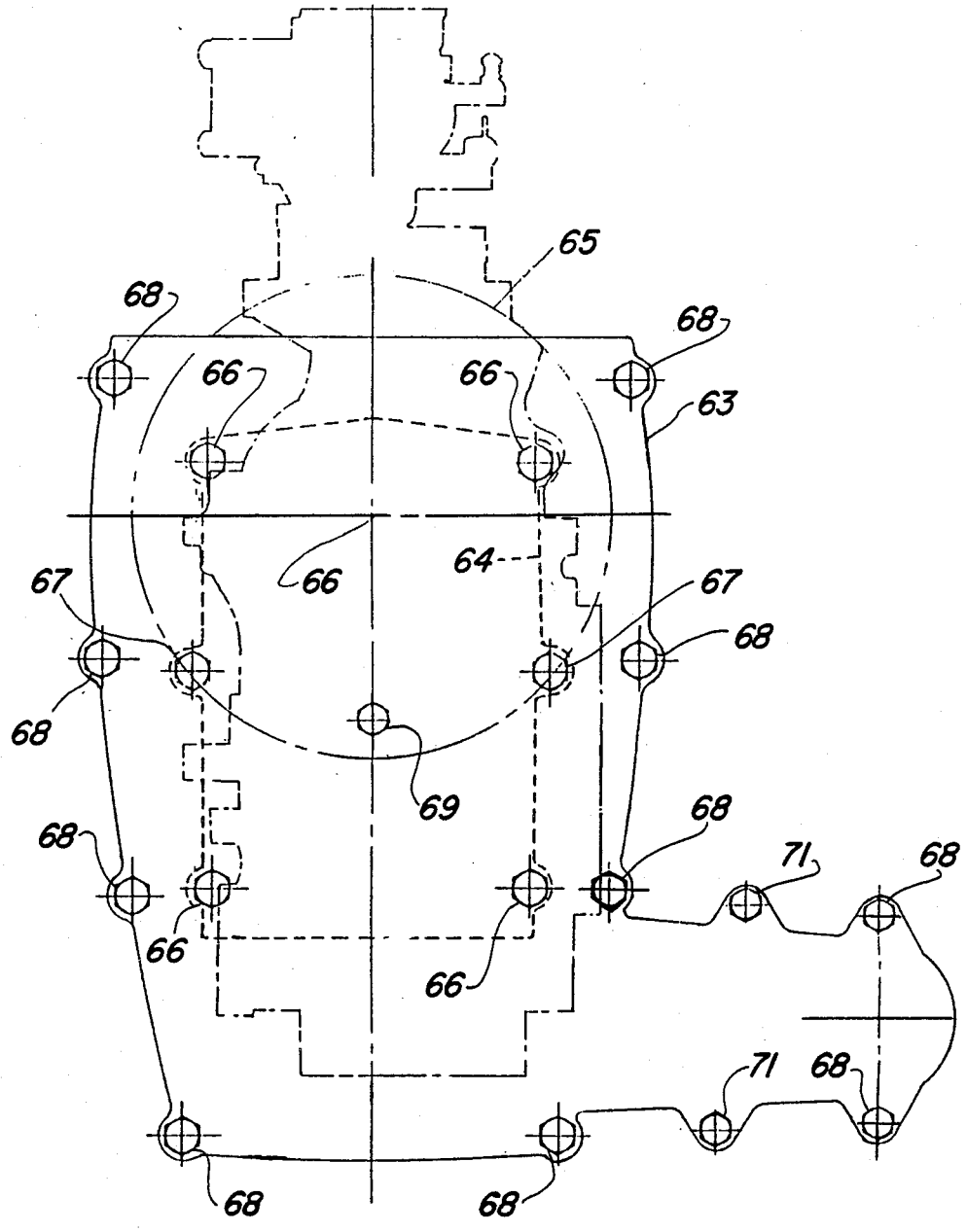
FIG. 4 is a view looking in the direction of the arrow 4 in FIG. 2 and shows the configuration of the connecting plate and the bolting pattern.

Referring now in detail to FIGS. 2 through 4, the engine of the power unit 15 is identified generally by the reference numeral 24 and may be of any known type. In the illustrated embodiment, the engine 24 is depicted as being an inline, two-cylinder, crankcase compression, two cycle engine. It is to be understood that other types of engines may be employed; however, as is typical with this form of application, the engine 24 is positioned so that its output shaft, crankshaft 25, rotates about a vertically disposed axis. The engine 25 is contained within the protective cowling which is comprised of a lower unit or tray 26 that is formed from a relatively rigid material such as cast aluminum or the like. A removable cover plate 27, which is formed from a light weight material such as molded fiberglass or the like is detachably affixed to the tray 26 in a suitable manner, as by means of fasteners 28.

The propulsion unit 16 is comprised of an outer housing assembly comprised of a casting 29. Contained within the casting 29 is a forward-neutral-reverse transmission, indicated generally by the reference numeral 31. This transmission 31 includes an input shaft 32 that is journalled within the casting 29 by means of a bearing assembly 33. The shaft 32 has an externally splined end 34 that mates with internal splines formed on the lower end of the crankshaft 25 for establishing driving connection therebetween.

The lower end of the input shaft 32 either has affixed to it or is integrally formed with a driving bevel gear 35. The driving bevel gear 35 is enmeshed with a pair of diametrically opposed, driven bevel gears 36 and 37. Because of the disposition of the driven gears 36 and 37, they will rotate in opposite directions.

The driven bevel gears 36 and 37 are rotatably journalled upon the propulsion shaft 17 which is journalled within the power unit casting 29 and which extends through one end of this casting. A bearing 39 and seal 41 are affixed to this end of the casting and a closure plate 42 holds the components together for providing a seal in this area. As noted previously, the propulsion shaft 17 is connected to the propeller shaft 19 of the watercraft as shown in FIG. 1.

A dog-clutching sleeve 43 has a splined connection to the propulsion shaft 17 between the leveled gears 36 and 37. The clutching sleeve 43 is axially slideable between these two gears and has dog-clutching teeth that are adapted to engage corresponding dog-clutching teeth on either of the gears 36 or 37 for selectively coupling such gears for rotation with the propulsion shaft 17 for driving the shaft 17 in selected forward or reverse directions.

A detent mechanism comprised of detent balls 44 and a biasing spring 45 cooperates with the dog-clutching sleeve 43 for selectively retaining it in either the forward position, the reverse position, or a neutral position wherein neither of the gears 36 or 37 is coupled for rotation with the propulsion shaft 17.

The mechanism for shifting the dog-clutching sleeve 43 includes a shifting fork 46 that is affixed to a selector shaft 47 and which has a pair of pins that are received within recesses formed on the clutching sleeve 43 so that rotation of the selector shaft 47 and shifting fork 46 will effect axial movement of the sleeve 43 along the propulsion shaft 17.

An access plate 48 is affixed across and closes an opening 49 formed in the lower portion of the casting 29 for servicing of the shifting mechanism. The access plate 48 is held in position by means of a plurality of bolts 51.

A shift lever 52 is affixed to an exposed end of the shift shaft 47 for rotating it and shifting the transmission in the known manner.

A water pump, indicated generally by the reference numeral 53 is driven by an end 54 of the propulsion shaft 17 for supplying coolant from the body of water in which the watercraft is operating to the engine 24 for its cooling. The coolant pump 53 includes a housing 55 that is affixed to the main casting 29 in a suitably manner and which contains an impeller 56 that rotates within a pumping cavity 57 of the housing 55. An inlet port 58 delivers water to the pumping cavity 57 and a discharge port 59 conveys the pumped coolant to the engine. A cover member 61 encloses the water pump 53 and defines a further water jacket 50 which surrounds this pump and which receives water pumped by the impeller 56. This water is discharged through a discharge fitting 62 that is connected to a suitable conduit for delivering the coolant to the engine.

Normally, the propulsion unit 16 is connected to the power unit 15 by means of fasteners which take a direct connection and a unitary assembly. As has been noted, however, such an arrangement is difficult in many regards such as servicing, appearance and assembly. In accordance with the invention, a connector plate, indicated generally by the reference numeral 63 is interposed between the lower portion of the tray 26 and the upper wall of the propulsion unit 16. In fact, this plate 63 may form an upper closure for a part of the casting 29 of the propulsion unit 16. In FIG. 4, the configuration of the various components are indicated at their mating interface. The lower surface of the engine 24 is indicated by the broken line 64 while the configuration of the connector plate 63 is indicated by the solid line bearing this reference numeral. The upper portion of the power unit 16 may have a configuration which is generally similar to that of the plate 16, however, there are certain flanged areas so as to afford a connection by threaded fasteners, to be described, while permitting free access to these connections from the external portion of the propulsion device 14.

The outer periphery of the fly wheel is indicated by the dot/dash circle 65 and it will be seen that the crankshaft rotational axis is indicated by the point 70. There are provided first series of threaded fasteners 66 in the form of bolts which extend through the underside of the connector plate 63 and which are threaded into tapped holes formed in the lower portion of the engine 24. These threaded fasteners also pass through openings in the tray 26 so as to affix the tray 26 to the engine 24 and the connector plate 63 to these two elements. Additional threaded fasteners 67 also perform a similar function.

Outwardly of the cavity containing the transmission 32, the casting member 29 is provided with a flange which mates with and is shaped correspondingly with the connector plate 63. Threaded fasteners in the form of a second series of bolts 68 extend through openings in this flange and in the plate 63 and are threaded into tapped openings formed in the tray 26 for affixing these components together. Therefore, it should be clear that removal of the bolts 68 will permit disassembly of the power unit 15 from the propulsion unit 16 which will greatly facilitate servicing. In addition to the fasteners thus far described, there may be provided still additional fasteners 69 and 71 for securing various of the ocmponents to each other.

The exhaust gases from the engine 24 may be transferred downwardly through the tray 26 and connector plate 63 through appropriate shaped openings for discharge through an exhaust gas discharge opening 72 that is formed in the casting 29. An upwardly extending exhaust gas discharge pipe 74 (FIG. 1) receives the exhaust gases from the opening 72 and discharges them to the atmosphere.

It should be readily apparent from the foregoing description that an extremely effective arrangement is provided for coupling an engine and transmission unit to each other in a neat and yet serviceable manner. Although the invention has been described in conjunction with a preferred embodiment of the invention, various changes and modifications may be made without departing from the spirit and scope of the invention, as defined by the appended claims.

I claim:

1. A power device comprised of an internal combustion engine contained within a protective cowling and having its output shaft rotatable about a generally vertically extending axis, a propulsion unit positioned beneath said protective cowling and having an outer casing containing a transmission driven by said engine output shaft and driving a propulsion shaft, the driving connection between said engine output shaft and said transmission affording removal of said transmission and said outer casing as a unit, a connector plate affixed to said engine by a first set of fasteners positioned about the axis of said output shaft approximately at a first distance, said fasteners of said first set being accessible from beneath said engine and only accessible from externally of engine when said engine, said protective cowling and said connect plate are all connected together and are removed from said propulsion unit outer casing, and a second set of fasteners positioned about the axis of said output shaft approximately at a second distance greater than said first distance, said second set of fasteners affixing said propulsion unit to said connector plate and being accessible from beneath said engine and accessible from externally of engine and externally of said outer casing of said transmission when said engine, said protective cowling and said transmission are all connected together for removing said connector plate, said engine and said protective cowling as a unit from said propulsion unit out casing and said transmission without necessitating disassembly of said transmission.

2. A power unit comprised of an internal combustion engine as in claim 1 wherein the propulsion unit transmission device comprises a forward-neutral-reverse transmission for driving the propulsion shaft in selected forward and reverse direction.

3. A power unit comprised of an internal combustion engine as in claim 1 wherein the protective cowling comprises a tray and the threaded fasteners are threadedly connected to the tray.

4. A power unit comprised of an internal combustion engine as in claim 2 wherein the input to the forward, neutral reverse transmission comprises a driving bevel gear having a splined connection with the engine output shaft for permitting removal of the transmission and outer casing from the engine protective cowling unit and connector plate as a unit from the propulsion unit outer casing.

* * * * *